US011401476B2

(12) United States Patent
Abraham et al.

(10) Patent No.: US 11,401,476 B2
(45) Date of Patent: Aug. 2, 2022

(54) AFTERTREATMENT ARRANGEMENT AND METHOD FOR THE AFTERTREATMENT OF AT LEAST GASES DOWNSTREAM OF A FLUID BED GASIFICATION SYSTEM, AND LOGIC UNIT AND USE

(71) Applicant: GIDARA ENERGY B.V., Nootdrop (NL)

(72) Inventors: Ralf Abraham, Bergkamen (DE); Domenico Pavone, Bochum (DE); Dobrin Toporov, Dortmund (DE); Herbert Palmowski, Duisburg (DE)

(73) Assignee: GIDARA ENERGY B.V., Nootdrop (NL)

( * ) Notice: Subject to any disclaimer, the term of this patent is extended or adjusted under 35 U.S.C. 154(b) by 41 days.

(21) Appl. No.: 16/622,767

(22) PCT Filed: Jun. 8, 2018

(86) PCT No.: PCT/EP2018/065198
§ 371 (c)(1),
(2) Date: Dec. 13, 2019

(87) PCT Pub. No.: WO2018/228946
PCT Pub. Date: Dec. 20, 2018

(65) Prior Publication Data

US 2021/0147755 A1 May 20, 2021

(30) Foreign Application Priority Data

Jun. 14, 2017 (DE) ..... 10 2017 210 044.3

(51) Int. Cl.
*C10J 3/54* (2006.01)
*C10J 3/72* (2006.01)
*C10J 3/84* (2006.01)

(52) U.S. Cl.
CPC ..... *C10J 3/54* (2013.01); *C10J 3/723* (2013.01); *C10J 3/84* (2013.01); *C10J 2300/0976* (2013.01); *C10J 2300/1615* (2013.01)

(58) Field of Classification Search
CPC ..... C10J 3/54; C10J 3/23; C10J 3/84
See application file for complete search history.

(56) References Cited

U.S. PATENT DOCUMENTS 2,605,178 A * 7/1952 Hemminger ..... C01B 3/30 48/215
4,474,583 A 10/1984 Chen et al.
(Continued)

FOREIGN PATENT DOCUMENTS

CN 201684496 12/2010
EP 1201731 5/2002
(Continued)

OTHER PUBLICATIONS

International Search Report dated Sep. 12, 2018 for PCT/EP2018/065198.
(Continued)

*Primary Examiner* — Matthew J Merkling
(74) *Attorney, Agent, or Firm* — Dentons Bingham Greenebaum LLP; Brian W. Chellgren

(57) ABSTRACT

The invention relates to an aftertreatment arrangement (1.0) for the aftertreatment of at least gases downstream of a fluidized bed gasification process, in particular downstream of an HTW gasifier (1) of a pressure-loaded fluidized bed gasification process, having a particle separation unit (2; 11) which can be arranged downstream of the fluidized bed gasification process and upstream of a gas cooler (3) that can be used for the further aftertreatment of the gases, wherein the aftertreatment arrangement comprises an intermediate cooling unit (12) which can be arranged downstream of the
(Continued)

Figure 1:
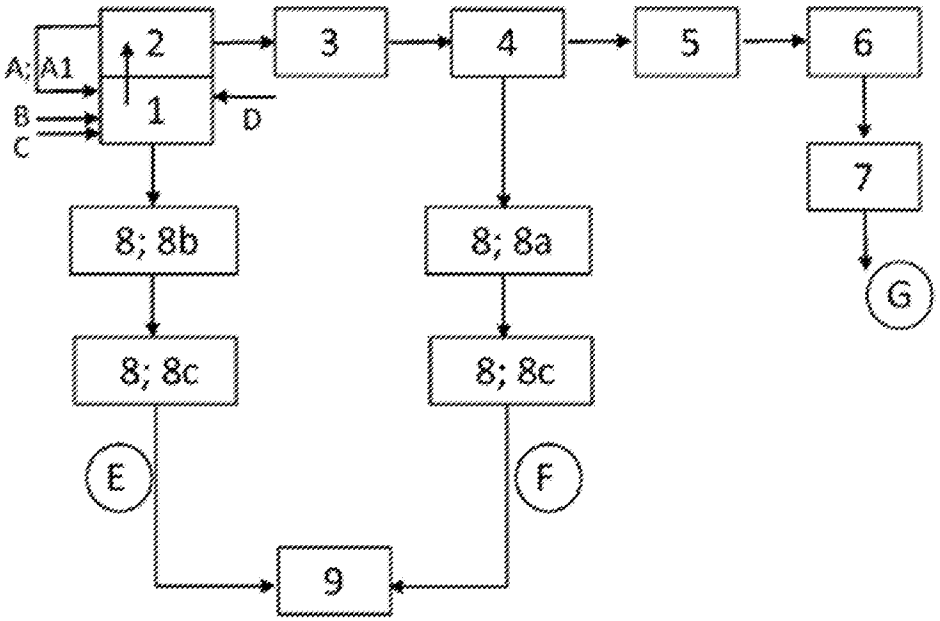

fluidized bed gasification process and upstream of the particle separation unit (11), having a return (B1) for gasification steam (B) that can be coupled to the fluidized bed gasification process. Furthermore, the invention relates to a method for the aftertreatment of at least gases downstream of a fluidized bed gasification process as well as the use of an intermediate cooling unit.

9 Claims, 2 Drawing Sheets

(56) References Cited

U.S. PATENT DOCUMENTS 4,483,692 A 11/1984 Patel
4,490,157 A * 12/1984 Fernandes ..... C10J 3/74 431/170
4,684,375 A * 8/1987 Morin ..... F23G 5/30 48/197 R
4,823,739 A * 4/1989 Marcellin ..... F23C 10/30 122/4 D
4,929,255 A * 5/1990 Hakulin ..... C10J 3/54 110/347
4,936,872 A * 6/1990 Brandl ..... C10K 1/20 252/373
4,969,930 A * 11/1990 Arpalahti ..... C10J 3/482 48/197 R
5,284,550 A * 2/1994 Tanca ..... C10J 3/54 162/30.1
5,544,479 A * 8/1996 Yan ..... F02C 3/205 60/39.464
5,620,487 A * 4/1997 Andrus, Jr. ..... C10J 3/78 48/69
5,626,088 A * 5/1997 Hiltunen ..... F23C 1/00 110/243
6,214,065 B1 * 4/2001 Berg ..... C10J 3/54 422/145
6,401,635 B1 * 6/2002 Nieminen ..... C22B 7/005 110/238
7,896,956 B2 * 3/2011 Takase ..... B01D 46/006 95/278
2006/0150510 A1 * 7/2006 Hiltunen ..... C10J 3/482 110/341
2008/0202985 A1 * 8/2008 Hatfield ..... C10K 1/101 208/403
2010/0126350 A1 * 5/2010 Sharma ..... B01D 46/0041 95/268
2010/0305220 A1 * 12/2010 Kukkonen ..... C10K 1/002 518/700
2016/0200991 A1 * 7/2016 Gau ..... C10J 3/84 252/373
2018/0050910 A1 * 2/2018 Dichand ..... C01B 3/54

FOREIGN PATENT DOCUMENTS

FR 2493333 5/1982
RU 2237703 10/2004
RU 113678 2/2012
RU 2616196 4/2017
WO 0071644 A1 11/2000
WO WO 00/71644 11/2000

OTHER PUBLICATIONS

Office Action and Search Report for Chinese Patent Application No. 2018800457028, dated Dec. 29, 2020.
Zhengyan Cao et al., "Clean Coal Technologies of China," China Logistics Publishing House, 1998.
Gyoguang Wu, "Coal Gasification Process," China University of Mining and Technology Press, 2015.
Search Report for Chinese Patent Application No. 2018800457028, dated May 21, 2021 (English translation).
Second Office Action for Chinese Patent Application No. 2018800457028, dated May 21, 2021 (English translation).
European examination report, dated Aug. 16, 2021—European application No. 18730743.4 Applicant: Gidara Energy B.V.
Russian examination report, dated Sep. 28, 2021—Russian application No. 2019141475 Applicant: Gidara Energy B.V.
D. Toporov, M. Forster, R. Kneer "OXYCOAL-AC: Towards the Realisation of a Coal-Fired Power Plant Process with Membrane-based Oxygen Supply—a Survey of Accumulated Experience" Clearwater Clean Coal Conference 2010.

* cited by examiner

AFTERTREATMENT ARRANGEMENT AND METHOD FOR THE AFTERTREATMENT OF AT LEAST GASES DOWNSTREAM OF A FLUID BED GASIFICATION SYSTEM, AND LOGIC UNIT AND USE

The invention relates to an arrangement and a method for the aftertreatment of at least gases downstream of a fluidized bed gasification process, particularly downstream of an HTW gasifier. In particular, particle separation and cooling must thereby take place. Furthermore, the invention also relates to the use of components for treating the gas in this arrangement. In particular, the invention relates to an arrangement and a method according to the preamble of the respective claim.

High-temperature Winkler (HTW) gasification is performed at elevated pressure and can be described as a pressure-loaded fluidized bed gasification process, particularly for pressures above 20 bar, at which dust is discharged out of the system. In contrast, the original Winkler fluidized bed gasification was performed at ambient pressure. HTW gasification can be advantageously used for a broad range of applications. For example, one can mention: production of synthesis gas particularly for products of the petrochemical industry, applications in power plants for power generation, or gasification of biomass, domestic waste or black coal having a high ash content.

Conventionally, a return cyclone is used in HTW gasification. The fine dust-laden raw gas is conducted from the gasifier to a raw gas cooler via the return cyclone. In many cases, the efficiency or effectiveness of the dust separation in the return cyclone is not sufficiently high, particularly at high pressures or high gas densities due to problems in particle separation. For that reason, one or more warm gas filters are arranged downstream of the return cyclone or raw gas cooler. However, this is not a particularly satisfactory measure. Due to the inadequate particle separation, a high concentration of foreign matter, particularly carbon, is deposited in the warm gas lifters, wherein the foreign matter can then no longer be utilized in a simple manner, but must be returned to the process in a complex manner or must be disposed of separately. In particular, the foreign matter accumulating in the warm gas filter must be returned to the gasifier by means of a circulation system (particularly also screw conveyors), or be incinerated in separate boilers with great effort, for which occasionally auxiliary fuels must also be supplied.

EP 1 201 731 A1 describes a fluidized bed gasifier having first and second post-gasification zones, which in contrast to conventional HTW gasifiers, allows all the ash to remain in the system by means of a return zone. In a splash zone provided above the fluidized bed zone, dust loading of the raw gas is lowered prior to entry into a cooling zone. Cooling occurs by dissipating overheated steam to a temperature range of preferably 550 to 650° C.

DE 10 2006 017 353 A1 describes an almost unpressurized method for process-integrated gas purification, wherein intermediate cooling to 150 to 700° C. and dust removal occurs in a so-called multicyclone and in a downstream row of sinter metal filters.

DE 43 39 973 C1 describes a method for the gasification of waste matter.

However, methods to date cannot be satisfactorily used in many respects in connection with fluidized bed gasification, particularly not for or during HTW gasification. Increased requirements in terms of efficiency, purity and flexibility in the process require further development of existing plants and methods.

The object of the invention is to provide an arrangement and a method in connection with a fluidized bed gasification process, particularly HTW gasification, with which various input materials can be advantageously treated in or after fluidized bed gasification particularly pressure-loaded fluidized bed gasification (HTW process). In particular, the largest possible range of operating pressures is to be made possible. High cost-efficiency and high operating reliability are obviously also desired, ultimately to ensure good readiness for practical applications.

According to the invention, this task is achieved by an aftertreatment arrangement for the aftertreatment of at least gases and optionally also for the aftertreatment of bottom product) downstream or on the discharge side of a fluidized bed gasification process, particularly downstream of an HTW gasifier of a pressure-loaded fluidized bed gasification process, having a particle separation unit arranged/arrangeable downstream of the fluidized bed gasification process and upstream of a (raw) gas cooler usable for the additional aftertreatment of the gases, wherein the aftertreatment arrangement comprises an intermediate cooling unit downstream from the fluidized bed gasification process and upstream of the particle separation unit, having a return, coupled/couplable to the fluidized bed gasification process, of gasification steam. This provides high efficiency generally during fluidized bed gasification, and especially in connection with an HTW gasifier. Steam can be used directly as a gasifying medium. In particular the separation of foreign matter or dust can take place more effectively. Last but not least, a particularly high gasification efficiency can be achieved. In addition, plant costs can be reduced, particularly in regard to screw conveyors (discharge scrolls) that are no longer needed when operating the warm gas filter.

An arrangement "downstream of a fluidized bed gasification process," particularly "downstream of an HTW gasifier" refers to an arrangement behind the respective component in the flow direction of the gas toward a discharge of synthesis gas.

Hereinafter, reference will be made interchangeably to fluidized bed gasification and simultaneously HTW gasification, and vice versa. The intermediate cooling unit may be arranged directly downstream from the HTW gasifier, in other words without the interposition of additional components or method steps.

The particle separation unit may be arranged directly downstream of the intermediate cooling unit, in other words without the interposition of additional components or method steps.

An arrangement "on the discharge side of" refers to an arrangement in the material flow direction of bottom products, in other words in the direction toward a plant component, by means of which bottom product or dust are discharged.

The aftertreatment arrangement can thereby also comprise the components already used to date in an HTW process, e.g., the HTW gasifier and/or the raw gas cooler.

According to an embodiment, the particle separation unit is constructed as a cyclone candle filter unit. One can hereby achieve method-related advantages; in particular, effective fine separation in downstream ceramic filters is made possible. The cyclone candle filter unit can be constructed together with the intermediate cooling unit as a combined plant/method component.

According to an embodiment, the cyclone candle filter unit has a dust return coupled/couplable to the fluidized bed gasification process or to the HTW gasifier. An efficient process is hereby made possible. In particular, this results in the advantage that the cyclone candle filter unit can be used repeatedly as a type of pre-separator.

According to an embodiment, the aftertreatment arrangement comprises a bottom product oxidation chamber arranged/arrangeable on the discharge side of the fluidized bed gasification process or the HTW gasifier, particularly coupled/couplable to the HTW gasifier, particularly set up for converting carbon. Carbon can hereby be reduced in such a manner that the bottom product becomes suitable for landfill disposal, particularly when it has less than 4 percent carbon by weight.

According to an embodiment, the aftertreatment arrangement comprises a bottom product cooling unit arranged/arrangeable on the discharge side of the fluidized bed gasification process or of the HTW gasifier, particularly arranged/arrangeable on the discharge side of a/the bottom product oxidation chamber or coupled/couplable to it.

According to an embodiment, the cyclone candle filter unit is combined with the intermediate cooling unit into one unit. One can hereby also cover a large temperature range. The combined unit can be arranged directly downstream from the HTW gasifier.

The aforementioned task is solved according to the invention by a method for the aftertreatment of at least gases (and optionally also for the aftertreatment of bottom product) downstream and on the discharge side respectively of a fluidized bed gasification process or an HTW gasifier of a pressure-loaded fluidized bed gasification process, comprising a particle separation unit arranged/arrangeable downstream of the fluidized bed gasification process and the HTW gasifier respectively and upstream of a (raw) gas cooling process usable for the additional aftertreatment of the gases, wherein gas from the fluidized bed gasification process is subjected to intermediate cooling upstream from the particle separation or is carried via at least one intermediate cooling unit, combined with a return of gasification steam from the intermediate cooling or an intermediate cooling unit back to the fluidized bed gasification process. An advantageous method can hereby be provided, particularly also a cost-effective, flexible application method.

Gasification steam can thereby be returned from intermediate cooling into the fluidized bed gasification process, by means of which particularly high flexibility in regard to process parameters can be achieved. In particular, the result is also a compact design. Last but not least, a lock system is not required.

According to an embodiment, intermediate cooling occurs to approx. 650° C., particularly from approx. 950° C. to at least roughly 650° C. or exactly 650° C. Coupling to a/the cyclone candle filter unit can thereby occur in a simple manner, A temperature of at least roughly 650° C. thereby also refers to a temperature in the range from 640 to 660° C.

According to an embodiment, particle separation is performed by means of a cyclone candle filter unit. The load or strain of additional filter units can hereby be minimized. The cyclone candle filter unit offers advantages for the entire process, particularly in the process chain described here.

According to an embodiment, dust is returned from the particle separation process into the fluidized bed gasification process. This results in process-related advantages.

According to an embodiment, oxidation of the bottom product occurs, particularly of carbon, on the discharge side of the fluidized bed gasification process. Bottom product from the fluidized bed gasification process or from the HTW gasifier is oxidized, particularly in an oxidation chamber arranged downstream from the HTW gasifier. Last but not least, this allows or simplifies transferring the bottom product to the landfill.

According to an embodiment, bottom product cooling occurs on the discharge side of the fluidized bed gasification process or on the discharge side of the HTW gasifier, particularly on the discharge side of a/the oxidation process of the bottom product or a corresponding oxidation chamber. This results in the aforementioned advantages.

According to an embodiment, downstream from the fluidized bed gasification process or the HTW gasifier, the gas is subjected in sequence first to intermediate cooling, then particle separation and then a/the (raw) gas cooling process. This method combination results in an overall process that is usable in a particularly flexible manner, also in connection with a streamlined plant design.

According to an embodiment, synthesis gas is produced, whereby gas from the fluidized bed gasification process downstream from the (raw) gas cooling process is conducted through at least one water scrubbing unit, one shift unit and a desulfurization unit. The method can hereby be coupled in a simple manner to additional aftertreatment steps. The shift unit may be provided by a fixed bed with a catalytic converter. The previously used warm gas filter is thereby no longer necessary particularly due to the cyclone candle filter.

The method described earlier can be performed advantageously by means of an aftertreatment arrangement described earlier.

The aforementioned task is also achieved according to the invention by a logic unit set up for controlling a method described earlier, particularly in an aftertreatment arranged described earlier, wherein the logic unit is coupled to the intermediate cooling unit and is set up to regulate the cooling of the gases, particularly in a range between 950° C. and 650° C., and is set up for regulating a gas supply to a particle separation unit or also to a bottom product oxidation chamber, particularly for regulating at least one volume flow. This results in the aforementioned advantages.

The aforementioned task is also achieved according to the invention by using an intermediate cooling unit downstream from a fluidized bed gasification process or an HTW gasifier and upstream of a particle separation unit for gases from the fluidized bed gasification process, combined with a dust return from the intermediate cooling unit back to the fluidized bed gasification process, particularly in the production of synthesis gas in an aftertreatment arrangement described earlier or in a process described earlier. This results in the aforementioned advantages.

Figure 2:
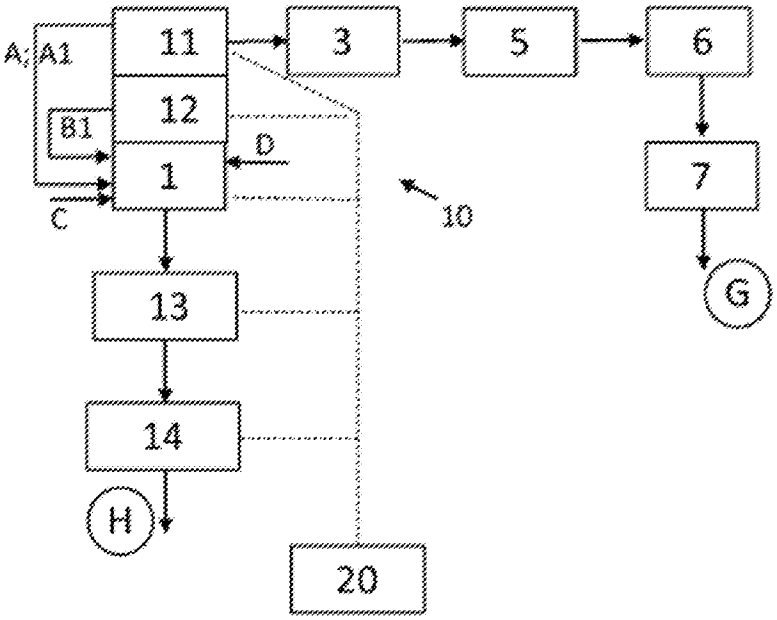

Additional features and advantages of the invention emerge from the description of at least one embodiment using drawings, as well as from the drawings themselves. In regard to reference signs that are not described explicitly in reference to an individual drawing, reference shall be made to the other drawings. Shown in a schematic depiction in each case are:

FIG. 1 an arrangement having an HTW gasifier, in which gas is discharged downstream into a return cyclone and into a bottom product cooling screw and FIG. 2 an aftertreatment arrangement according to an embodiment integrated downstream or on the discharge side of an HTW gasifier.

FIG. 1 depicts a high-temperature Winkler (HTW) gasifier 1, a return cyclone (particle separator) 2 arranged downstream thereof on a first gas flow path, downstream from that a raw gas cooler 3, a warm gas filter 4, a water scrubbing process or water scrubbing unit 5, a shift process or a shift unit 6, a desulfurization process or desulfurization unit 7, as well as in each case downstream from the HTW gasifier 1, arranged on a second and third gas flow path respectively a transport device, particularly a screw 8, designed once as a cooling screw 8*a* for dust and designed once as a cooling screw 8*b* for bottom product further downstream from that in each case a discharge screw 8*e*, and lastly a fluidized bed chamber 9.

There is a dust return A1 of dust A from the particle separator 2 back to the HTW gasifier 1. The HTW gasifier 1 is supplied with gasification steam B as well as air, oxygen, CO2 (feed C) as well as fuel D. Carbon-containing bottom product E and carbon-containing dust F are supplied to the fluidized bed chamber 9. Synthesis gas G is discharged downstream from the desulfurization unit 7.

FIG. 2 depicts an aftertreatment arrangement 10 having a particle separation process or a particle separation unit 11, particularly constructed as a cyclone candle filter unit. Intermediate cooling or an intermediate cooling unit 12 is provided downstream from the HTW gasifier 1 and upstream from the cyclone candle filter unit 11.

There is a dust return A from the particle separator 11 back to the HTW gasifier 1. The HTW gasifier 1 is supplied with gasification steam B, said gasification steam B able to be returned from the intermediate cooling unit 12 via a return line B1. The HTW gasifier 1 is also supplied with air, oxygen, CO2 (feed C) as well as fuel D.

Downstream from the cyclone candle filter unit 11 arranged on a first gas flow path, there are arranged a raw gas cooler 3, a water scrubbing process or a water scrubbing unit 5, a shift process or a shift unit 6 as well as a desulfurization process or a desulfurization unit 7. Synthesis gas G is discharged downstream from the desulfurization unit 7. A warm gas filter (reference sign 4 in FIG. 1) is no longer needed. On account of the cyclone candle filter 11, a warm gas filter can be omitted.

Transport devices, particularly screws, are not provided. Instead, downstream from the HTW gasifier 1 on a second gas flow path, there is arranged a bottom product oxidation process or at least one oxidation chamber 13 for bottom product and a bottom product cooling process or at least a bottom product cooling unit 14. Ash H is discharged downstream from the bottom product cooling process 14.

A logic unit 20 is coupled at least to the HTW gasifier 1, to the particle separation unit 11, to the intermediate cooling unit 12, to the oxidation chamber 13 and/or the bottom product cooling unit 14.

LIST OF REFERENCE SIGNS

1 Fluidized bed gasification process with high-temperature Winkler (HTW) gasifier
2 Return cyclone (particle separator)
3 (Raw) gas cooler or (raw) gas cooling
4 Warm gas filter
5 Water scrubbing process or water scrubbing unit
6 Shift process or shift unit
7 Desulfurization process or desulfurization unit
8 Transport device, particularly a screw
8*a* Cooling screw for dust
8*b* Cooling screw for bottom product
8*c* Discharge screw
9 Fluidized bed chamber
A; A1 Dust or dust return
B; B1 Gasification steam or return for gasification steam
C Air, oxygen, CO2
D Fuel
E C-containing bottom product
F C-containing dust
G Synthesis gas
H Ash
10 Aftertreatment arrangement
11 Particle separation process or particle separation unit, particularly a cyclone cartridge filter unit
12 Intermediate cooling or intermediate cooling unit
13 Bottom product oxidation or oxidation chamber for bottom product
14 Bottom product cooling or bottom product cooling unit
20 Logic unit

The invention claimed is:

1. A method for the aftertreatment of at least gases downstream of a fluidized bed gasification process, downstream of an HTW gasifier (1) of a pressure-loaded fluidized bed gasification process, comprising a particle separation process (11) which is configured to be arranged downstream of the HTW gasifier (1) of the fluidized bed gasification process and upstream of a gas cooler (3) that is configured to be used for the further aftertreatment of the gases, wherein particle separation (11) is carried out by means of a cyclone candle filter unit;

characterized in that gas from the fluidized bed gasification process is subjected to intermediate cooling (12) directly upstream from the particle separation process (11) and directly downstream of the HTW gasifier (1) of the fluidized bed gasification process, combined with a return of gasification steam (B) from the intermediate cooling back to the fluidized bed gasification process; and wherein the intermediate cooling occurs to approximately 650° C.

2. The method according to claim 1, wherein the intermediate cooling (12) occurs to 650° C., optionally from approximately 950° C.

3. The method according to claim 1, wherein dust (A) is returned from the particle separation process (11) directly into the fluidized bed gasification process, optionally into the HTW gasifier (1).

4. The method according to claim 1, wherein an oxidation of the bottom product occurs on a discharge side of the fluidized bed gasification process; and/or wherein bottom product cooling (14) occurs on the discharge side of the fluidized bed gasification process, optionally on the discharge side of the oxidation (13) of the bottom product.

5. The method according to claim 1, wherein the gas downstream from the fluidized bed gasification process is subjected first to intermediate cooling (12), then particle separation (11) and then the gas cooling (3) in sequence.

6. The method according to claim 1, wherein synthesis gas (G) is produced by gas being guided out of the fluidized bed gasification process downstream of the gas cooling (3) through at least one water scrubbing unit (5), one shift unit (6) and one desulfurization unit (7).

7. A logic unit (20) set up for controlling a method according to claim 1, wherein the logic unit is coupled to an intermediate cooling unit (12) and is set up for regulating the cooling of the gases, optionally in a range between 950° C. and 650° C., and is set up for regulating a gas supply to a particle separation unit or also to a bottom product oxidation chamber, optionally for regulating at least a volume flow.

8. The method according to claim 1, wherein the particle separation process (11) is a single particle separation process (11).

9. A method for the aftertreatment of at least gases downstream of a fluidized bed gasification process, downstream of an HTW gasifier (1) of a pressure-loaded fluidized bed gasification process, comprising a particle separation process (11) which is configured to be arranged downstream of the HTW gasifier (1) of the fluidized bed gasification process and upstream of a gas cooler (3) that is configured to be used for the further aftertreatment of the gases, wherein particle separation (11) is carried out by means of a cyclone candle filter unit;

characterized in that gas from the fluidized bed gasification process is subjected to intermediate cooling (12) directly upstream from the particle separation process (11) and directly downstream of the HTW gasifier (1) of the fluidized bed gasification process, combined with a return of gasification steam (B) from the intermediate cooling back to the fluidized bed gasification process; and wherein the intermediate cooling occurs to within a temperature range of 640° C. to 660° C.

* * * * *